US009310124B2

(12) United States Patent
Chase et al.

(10) Patent No.: US 9,310,124 B2
(45) Date of Patent: Apr. 12, 2016

(54) MODULAR BUCKET AND DOOR ARCHITECTURE TO DELIVER THREE ICE FUNCTIONS

(75) Inventors: Kevin M. Chase, Saint Joseph, MI (US); Tony L. Koenigsknecht, Austin, TX (US); Kate E. Presnell, Kalamazoo, MI (US); Jerold M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1443 days.

(21) Appl. No.: 12/636,953

(22) Filed: Dec. 14, 2009

(65) Prior Publication Data

US 2011/0138837 A1 Jun. 16, 2011

(51) Int. Cl.

| | |
|---|---|
| ***F25C 1/14*** | (2006.01) |
| ***F25D 23/04*** | (2006.01) |
| ***F25C 5/00*** | (2006.01) |
| *F25C 5/04* | (2006.01) |
| *F25C 5/12* | (2006.01) |

(52) U.S. Cl.

CPC ..... *F25D 23/04* (2013.01); *F25C 5/005* (2013.01); *F25C 5/046* (2013.01); *F25C 5/12* (2013.01); *F25C 2400/08* (2013.01); *F25C 2400/10* (2013.01); *Y10T 29/49826* (2015.01)

(58) Field of Classification Search

CPC ..... F25C 5/0046; F25C 5/12
USPC ..... 62/320, 344; 241/DIG. 17
See application file for complete search history.

(56) References Cited

U.S. PATENT DOCUMENTS

| | | | | |
|---|---|---|---|---|
| 4,228,934 | A * | 10/1980 | Carr | 222/412 |
| 4,972,999 | A | 11/1990 | Grace | |
| 5,056,688 | A | 10/1991 | Goetz et al. | |
| 5,513,810 | A * | 5/1996 | Lin | 241/95 |
| 6,050,097 | A | 4/2000 | Nelson et al. | |
| 7,134,620 | B1 * | 11/2006 | Lee | 241/37.5 |
| 7,185,507 | B2 | 3/2007 | Maglinger et al. | |
| 7,278,275 | B2 * | 10/2007 | Voglewede et al. | 62/320 |
| 7,287,713 | B2 | 10/2007 | Akuzawa et al. | |
| 7,296,459 | B2 | 11/2007 | Son et al. | |
| 7,340,905 | B2 | 3/2008 | An | |
| 2006/0059939 | A1 | 3/2006 | An et al. | |
| 2006/0144976 | A1 | 7/2006 | Lee et al. | |
| 2006/0283202 | A1 * | 12/2006 | Oh et al. | 62/344 |
| 2007/0084230 | A1 | 4/2007 | Krause et al. | |
| 2007/0199406 | A1 | 8/2007 | Ramirez, Jr. et al. | |
| 2007/0199407 | A1 | 8/2007 | Ramirez et al. | |
| 2007/0214825 | A1 * | 9/2007 | Jeong et al. | 62/344 |

* cited by examiner

*Primary Examiner* — Jonathan Bradford
*Assistant Examiner* — Elizabeth Martin

(57) ABSTRACT

An appliance including a module-receiving cavity disposed in the appliance. Also included is a removable module disposed in the module-receiving cavity, and at least one ice modification member disposed inside the removable module. A motor is operably connected with the removable module and includes an output shaft that extends into the removable module. An impeller is connected with the output shaft proximate to the at least one ice modification member, the impeller being operable between a first ice manipulating condition defined by a first directional rotation of the impeller, and a second ice manipulating condition defined by a second directional rotation of the impeller. An ice chute is located proximate the ice modification member for dispensing ice.

20 Claims, 13 Drawing Sheets

MODULAR BUCKET AND DOOR ARCHITECTURE TO DELIVER THREE ICE FUNCTIONS

BACKGROUND OF THE INVENTION

Appliances are known for dispensing ice in various forms, such as ice cubes, crushed ice, and shaved ice. Some appliances that dispense ice in that fashion are domestic refrigeration appliances such as combined refrigerator/freezer appliances where the various forms of ice are delivered through the door of the appliance. While appliances generally do a good job of providing various forms of ice, there are limitations on being able to deliver three forms of ice from a single well with a single form of actuation (i.e., motor, actuator, etc). The provision of various forms of ice with multiple wells is limited to the spatial restraints of the appliance, while the introduction of multiple forms of actuation increases system complexity.

SUMMARY OF THE INVENTION

One object of the present invention is an appliance including a module-receiving cavity disposed in the appliance. Also included is a removable module disposed in the module-receiving cavity, and at least one ice modification member disposed inside the removable module. A motor is operably connected with the removable module and includes an output shaft that extends into the removable module. An impeller is connected with the output shaft proximate to the at least one ice modification member, the impeller being operable between a first ice manipulating condition defined by a first directional rotation of the impeller, and a second ice manipulating condition defined by a second directional rotation of the impeller. An ice chute is located proximate the ice modification member for dispensing ice.

Another object of the present invention is to provide an ice manipulation module. The module includes a housing adapted for removable connection with a module-receiving cavity, at least one ice modification member disposed inside the housing, and a motor operably connected with the ice manipulation module. The motor includes an output shaft that extends into the ice manipulation module. An impeller is connected with the output shaft proximate to the ice modification member, the impeller being operable between a first ice manipulating condition defined by a first directional rotation of the impeller, and a second ice manipulating condition defined by a second directional rotation of the impeller.

A further aspect of the present invention is to provide a method of making an appliance. The method includes the step of forming a module-receiving area adapted to engageably receive at least one of a plurality of ice manipulation modules selected from the group consisting of a crushed-cubed module, a shaved-cubed module, and a crushed-shaved module, wherein each one of the plurality of ice manipulation modules includes at least one ice modification member. Provided is a motor having an output shaft, adapted for rotation in a first direction and adapted for rotation in a second direction. An impeller is connected to the output shaft and is extended proximate the module-receiving area, wherein rotation of the output shaft in the first direction causes a first ice manipulating condition and wherein rotation of the output shaft in the second direction causes a second ice manipulating condition.

Additional objects, features, and advantages of the present invention will become more readily apparent from the following detailed description of the preferred embodiments when taken in conjunction with the drawings, wherein like reference numerals refer to corresponding parts in the several views.

DETAILED DESCRIPTION OF THE PREFERRED EMBODIMENTS

For purposes of description herein, the terms "upper," "lower," "right," "left," "rear," "front," "vertical," "horizontal," and derivatives thereof shall relate to the invention. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
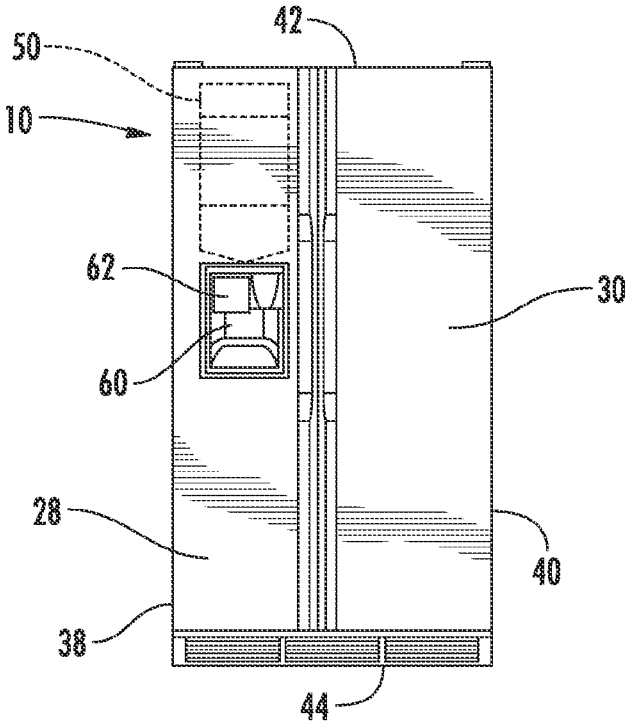
FIG. 1 is a front elevational view of an appliance having an ice manipulation module.
Figure 2:
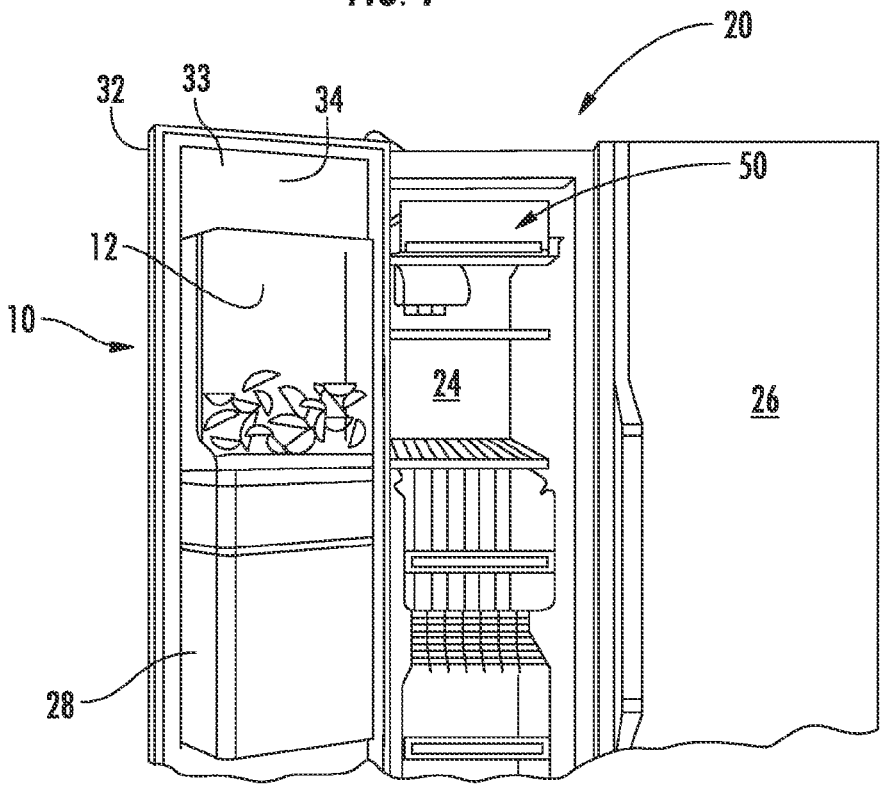
FIG. 2 is a front elevational view of the appliance having a freezer compartment and an above-freezing compartment.

Referring to FIGS. 1 and 2, the reference number 10 generally designates an ice manipulation module that includes a housing 11 adapted for removable connection with a module-receiving cavity 33. At least one ice modification member 70 or 72 is disposed inside the housing 11. A motor 90 is operably connected with the ice manipulation module 10 and includes an output shaft 92 that extends into the ice manipulation module 10. An impeller 76 is connected with the output shaft 92 proximate to the at least one ice modification member 70, 72, the impeller 76 being operable between a first ice manipulating condition defined by a first directional rotation A, and a second ice manipulating condition defined by a second directional rotation B.

The present invention provides various ice manipulation modules 10 for delivering ice in each of the three selected forms, namely, cubed, crushed, and shaved. Generally, as used herein, ice cubes or bodies of ice having a three dimensional (3D) shape, wherein a length in any of the dimensions is typically not less than about two centimeters (2 cm). Shaved ice comprises bodies of ice having a three dimensional (3D) shape, in which at least one of the dimensions has a length of no greater than about five millimeters (5 mm). Crushed ice comprises bodies of ice having a three dimensional (3D) shape, in which at least one of the dimensions has a length greater than about five millimeters (5 mm), but less than about two centimeters (2 cm), and no dimension has a length greater than about five centimeters (5 cm).

This ice manipulation module 10 can be arranged within an appliance 20, such as a domestic refrigerator having a refrigerated compartment, or other types of appliances, including freezers and ice makers. In the illustrated embodiment; as shown in FIGS. 1 and 2, a refrigerator 20 includes a cabinet forming a freezer compartment 24 and an above-freezing refrigeration compartment 26. Both the freezer compartment 24 and the above-freezing refrigeration compartment 26 are provided with access openings. A freezer door 28 and an above-freezing door 30 are hingedly mounted to the cabinet for closing the access openings. The doors 28, 30 of the appliance 20 have an exterior surface 32 and an interior surface 34 typically having a door liner. The refrigerator 20 also includes a rear wall section, a first side wall section 38, a second side wall section 40, a top 42, and a bottom 44. Although a side by side refrigerator is shown, it will be understood that the invention is not limited to such an arrangement.

An ice maker 50 is disposed within the freezer compartment 24. The ice maker 50 is an ice piece making apparatus which forms ice pieces, typically crescent shaped, although other shapes are conceivable. Such an ice maker 50 is taught in U.S. Pat. No. 7,278,275 entitled, "MECHANISM FOR DISPENSING SHAVED ICE FROM A REFRIGERATION APPLIANCE" the disclosure of which is incorporated herein by reference. The ice is then transferred to the ice manipulation module 10.

Figure 3A:
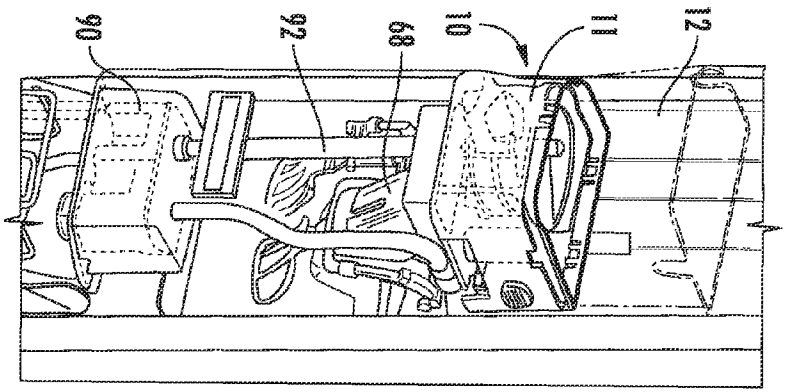
FIG. 3A is a top perspective view of the ice manipulation module.
Figure 3B:
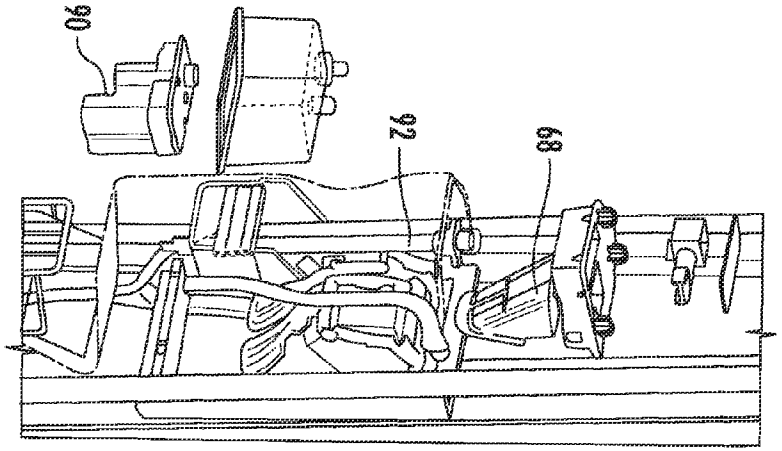
FIG. 3B is a top perspective view of a motor located within an appliance.
Figure 4:
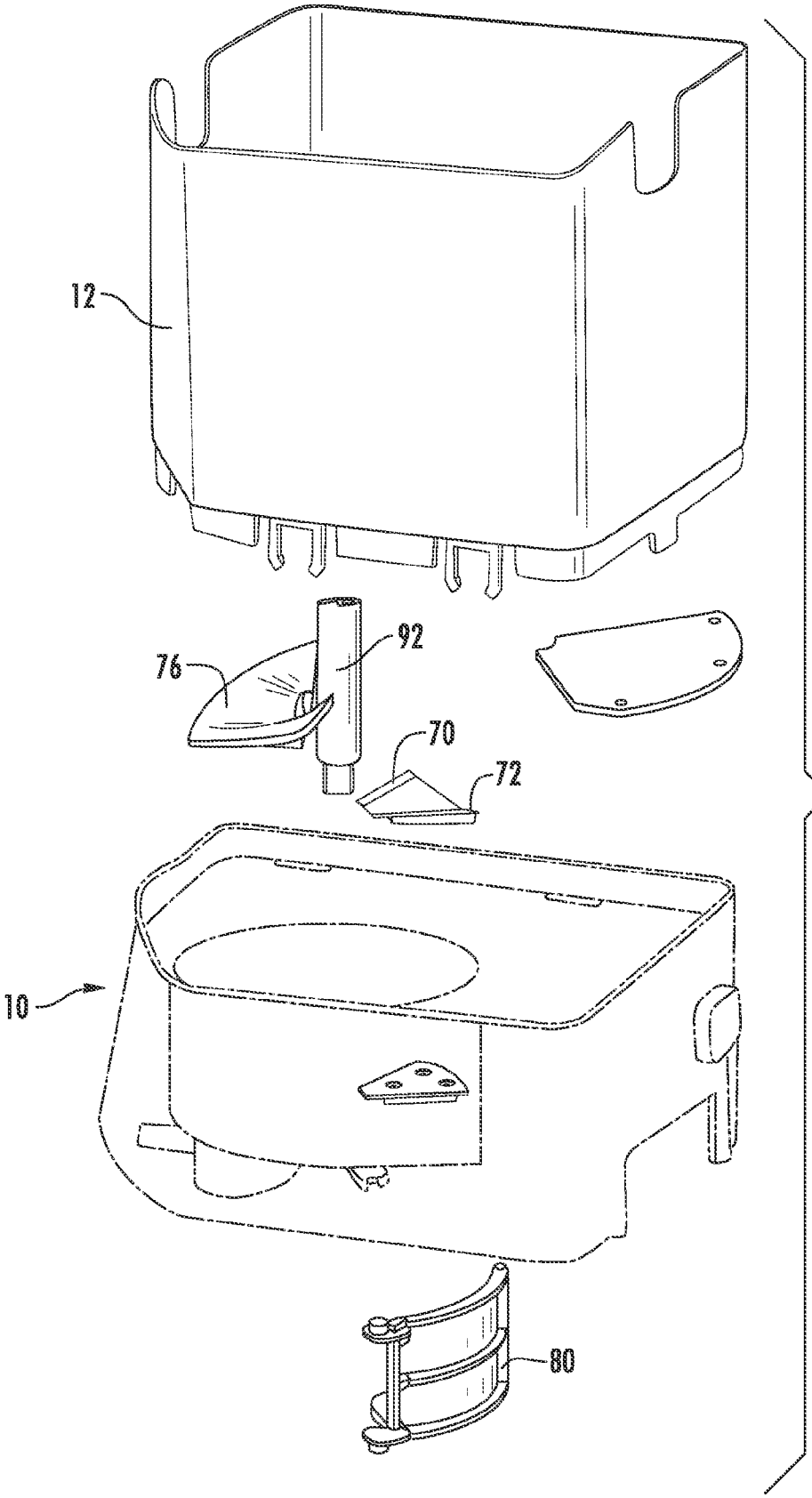
FIG. 4 is a top perspective exploded view of the ice manipulation module.
Figure 5:
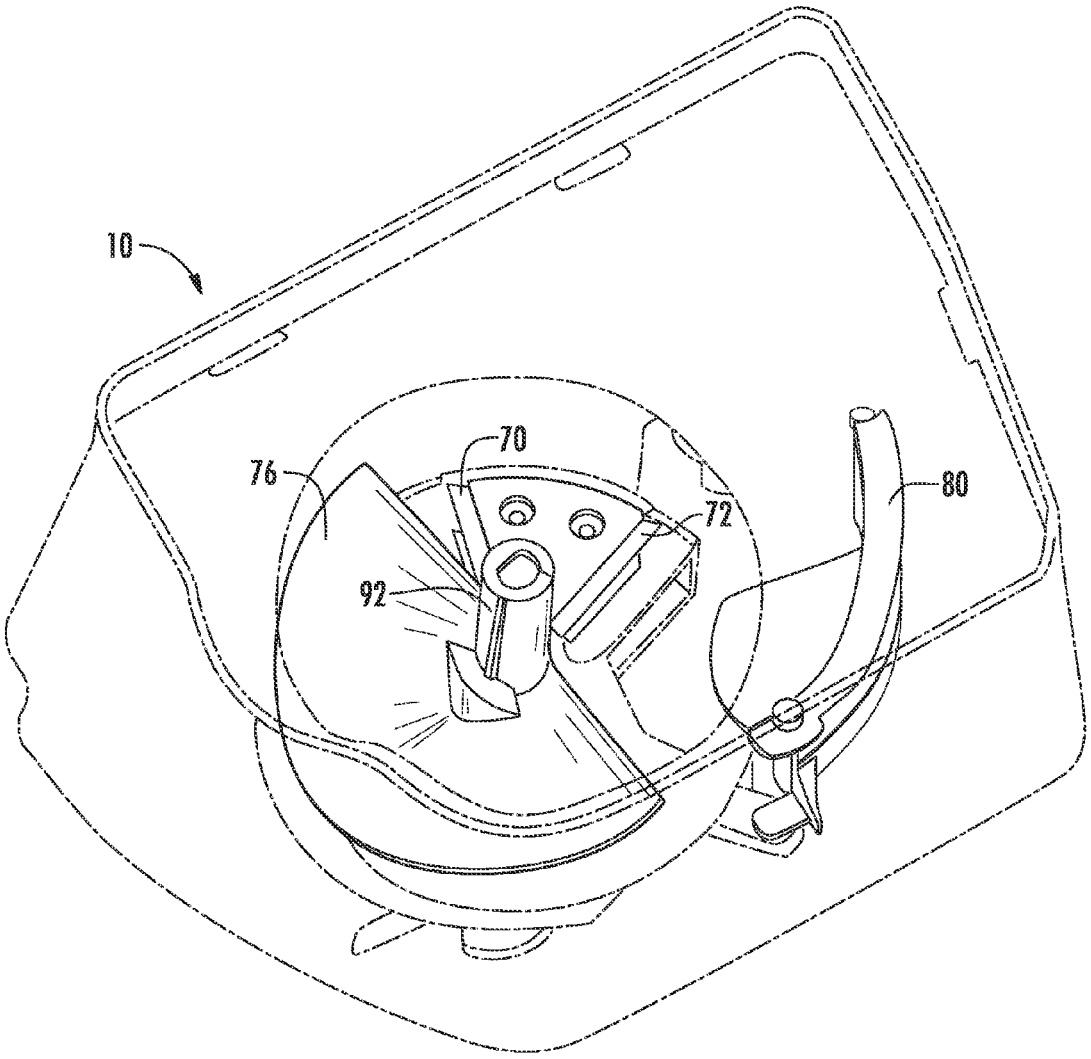
FIG. 5 is a top plan view of the ice manipulation module.
Figure 6:
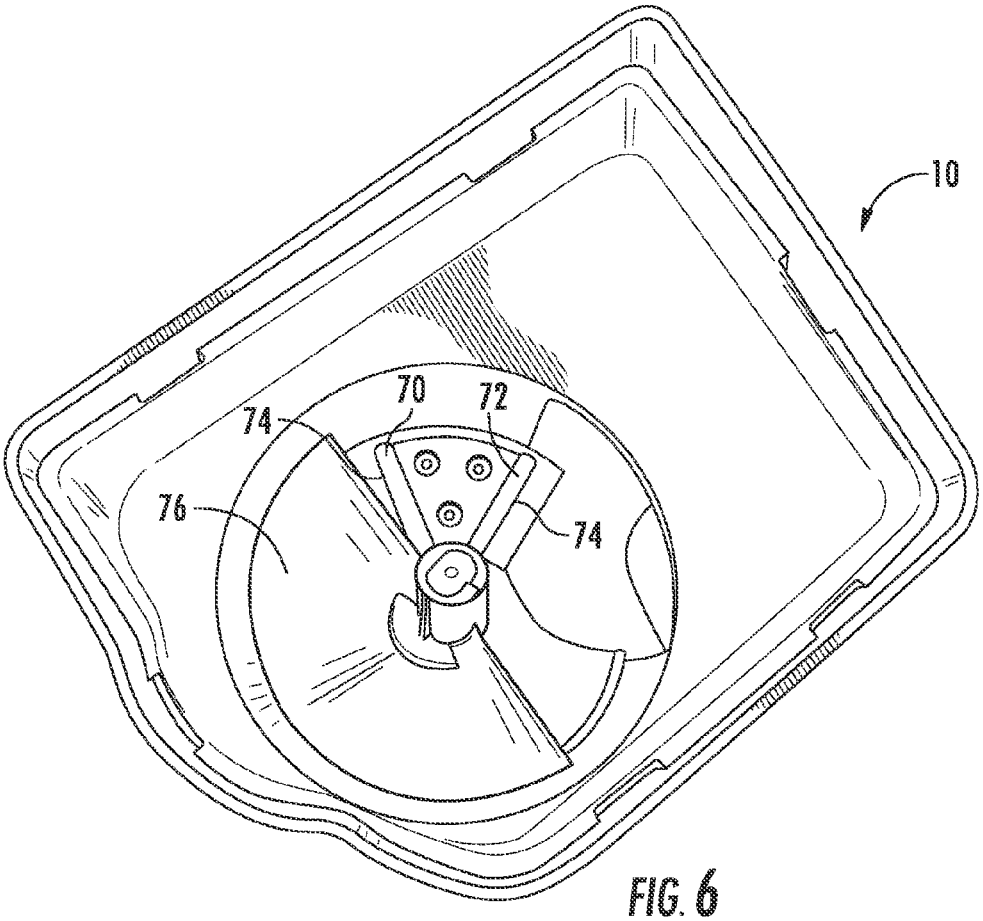
FIG. 6 is a top plan view of the ice manipulation module including at least one ice modification member.
Figure 7:
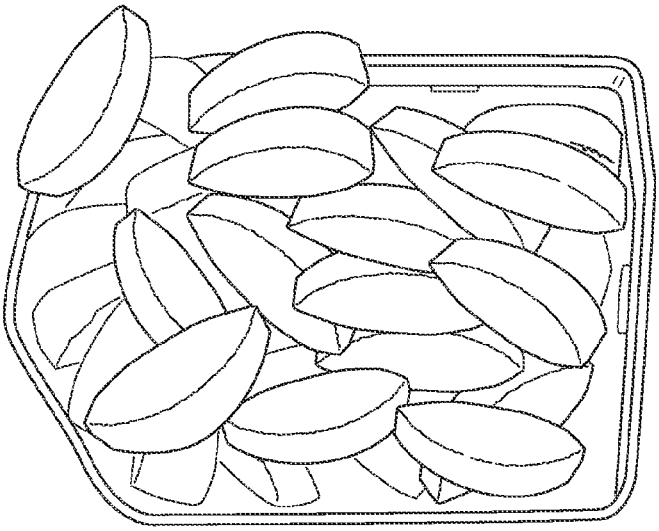
FIG. 7 is a top plan view of the ice manipulation module containing a plurality of ice pieces.
Figure 8:
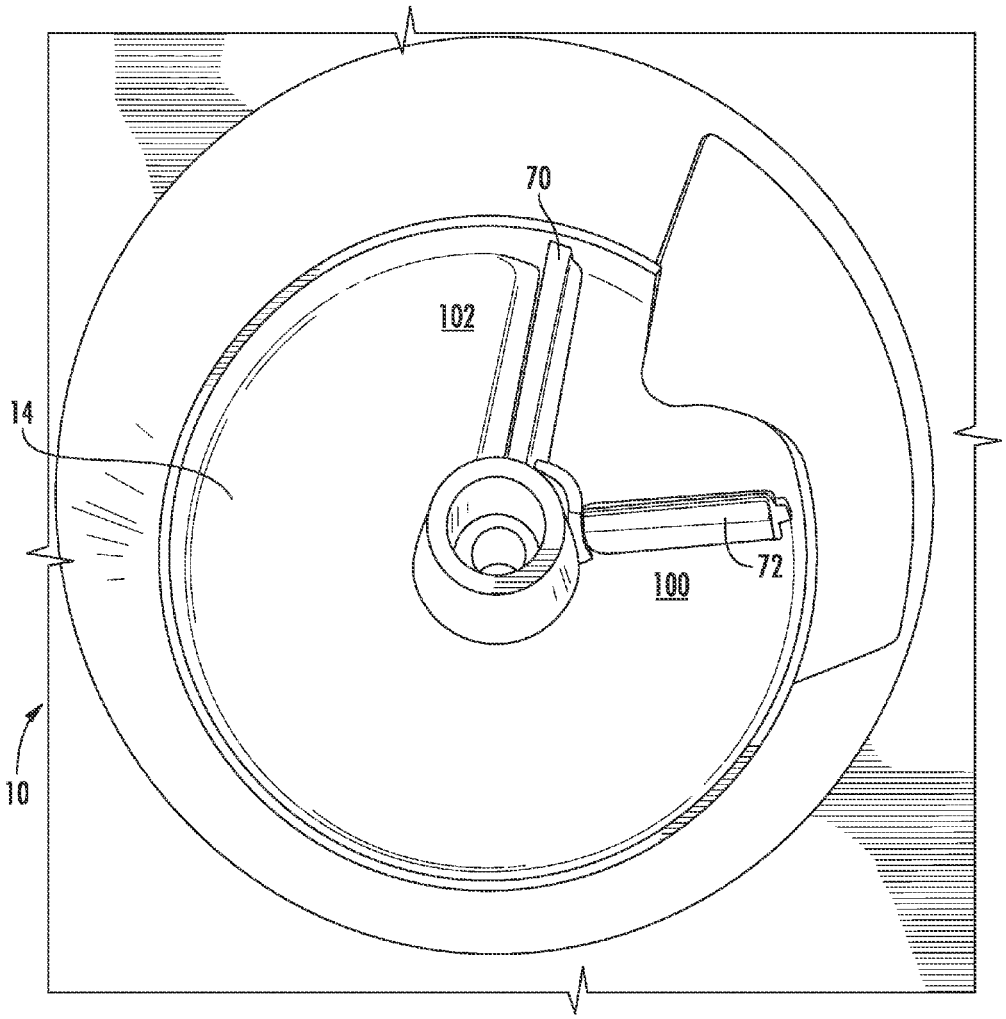
FIG. 8 is a top plan view of the ice manipulation module having a plurality of blades.
Figure 9:
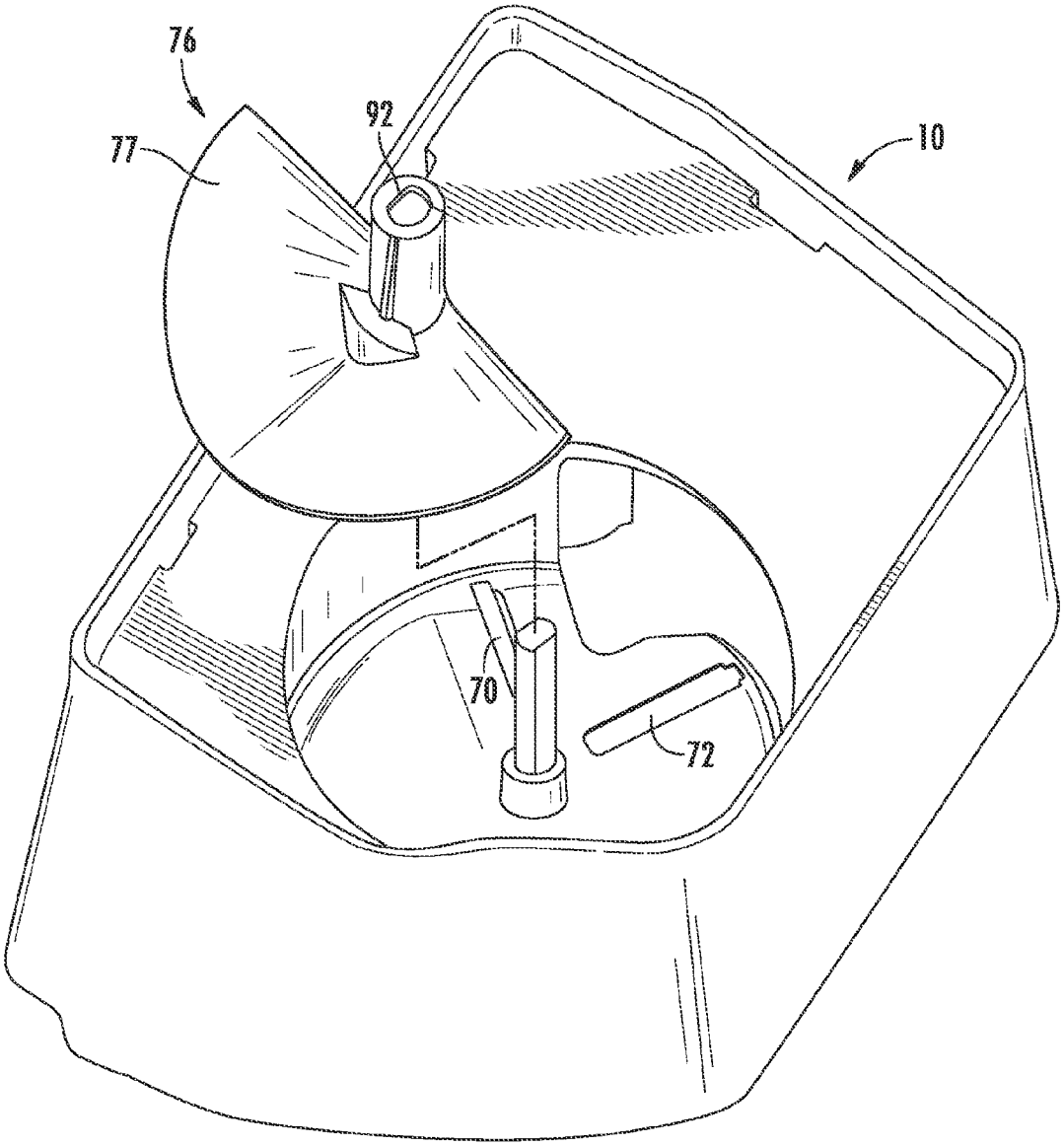
FIG. 9 is a top plan view of the ice manipulation module with the impeller removed from the shaft.

In one embodiment, as shown in FIGS. 3A and 3B, the ice manipulation module 10 may removably engage directly to the freezer door 28 and is typically positioned below the ice maker 50 for receiving ice pieces therefrom in a substantially vertical transfer; however, a substantially horizontal transfer of ice pieces from the ice maker 50 to the ice manipulation module 10 is conceivable. The ice manipulation module 10 includes a base 14 and at least one side wall. The side wall(s) may form a cylindrical shape or another geometric shape. Once the ice manipulation module 10 contains ice pieces, the ice manipulation module 10 is capable of modifying the pieces from their original, typically cubed form, into other forms of ice, thereafter dispensing the ice through a dispensing zone 60 when prompted by the user. Such ice manipulation is taught in U.S. patent application Ser. No. 12/636,905, entitled "THREE FUNCTIONS IN A SINGLE WELL," filed on Dec. 14, 2009, the disclosure of which is hereby incorporated by reference in its entirety. The user may prompt dispensing via a user interface 62 and/or a control mechanism 64 arranged to effect dispensing ice from the ice manipulation module 10 to the dispensing zone 60. The user interface 62 and the control mechanism also allow the user to selectively control the form of preferred ice to be dispensed. Specifically, the user may select dispensing of ice cubes, crushed ice, or shaved ice, either singularly or in combination, depending upon which ice modification module 10 is engaged to the appliance 20.

Figure 10:
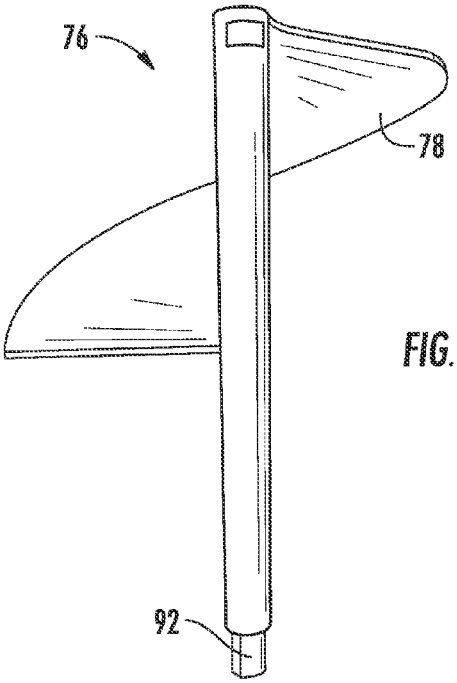
FIG. 10 is a front elevational view of one embodiment of an impeller having a helical geometry.
Figure 11:
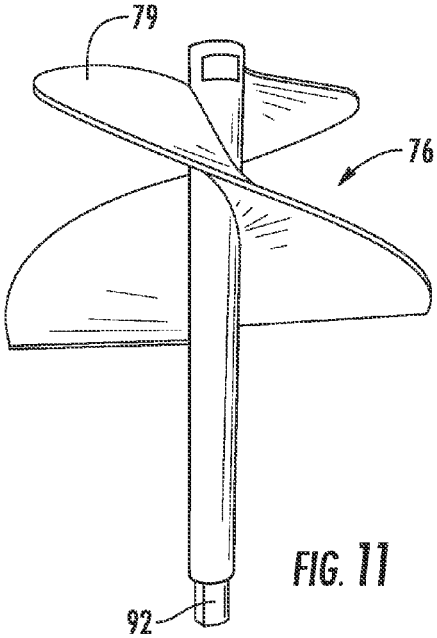
FIG. 11 is a front elevational view of another embodiment of an impeller having a double helix geometry.
Figure 12:
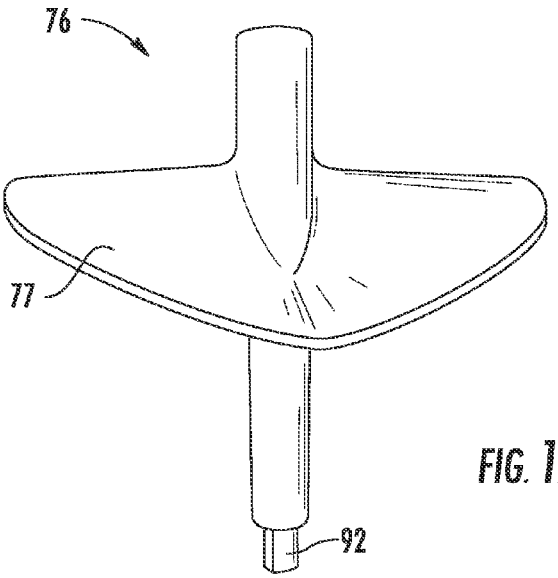
FIG. 12 is a front elevational view of another embodiment of an impeller having a shovel geometry.
Figure 13A:
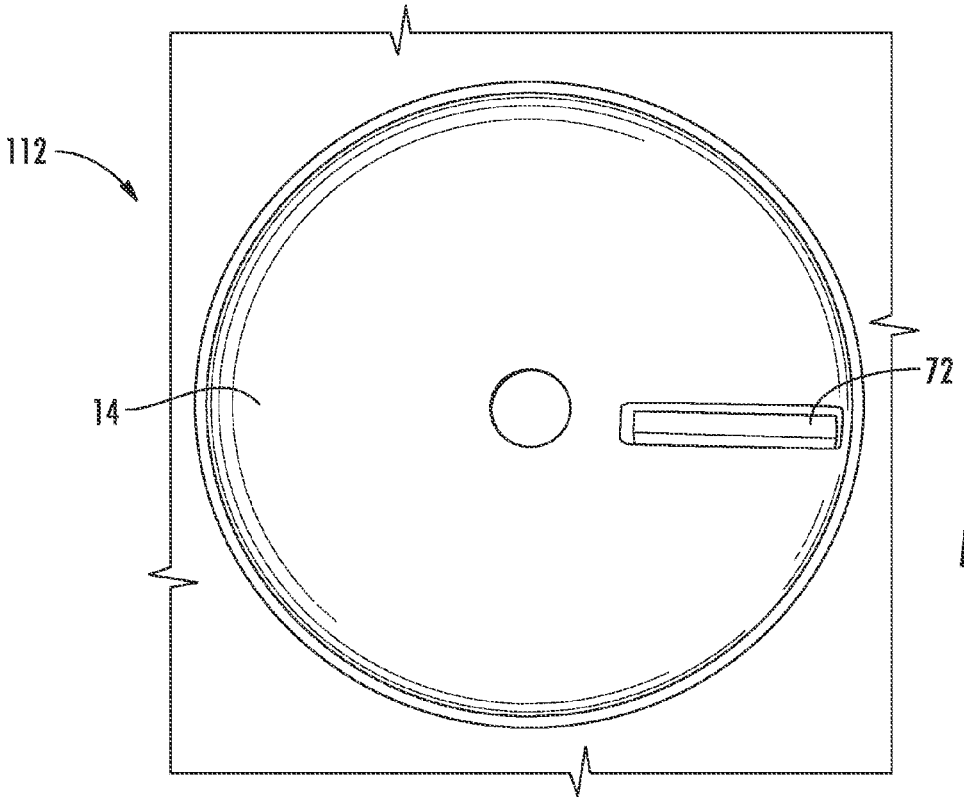
FIG. 13A is a top plan view of a shaved-cubed module.
Figure 13B:
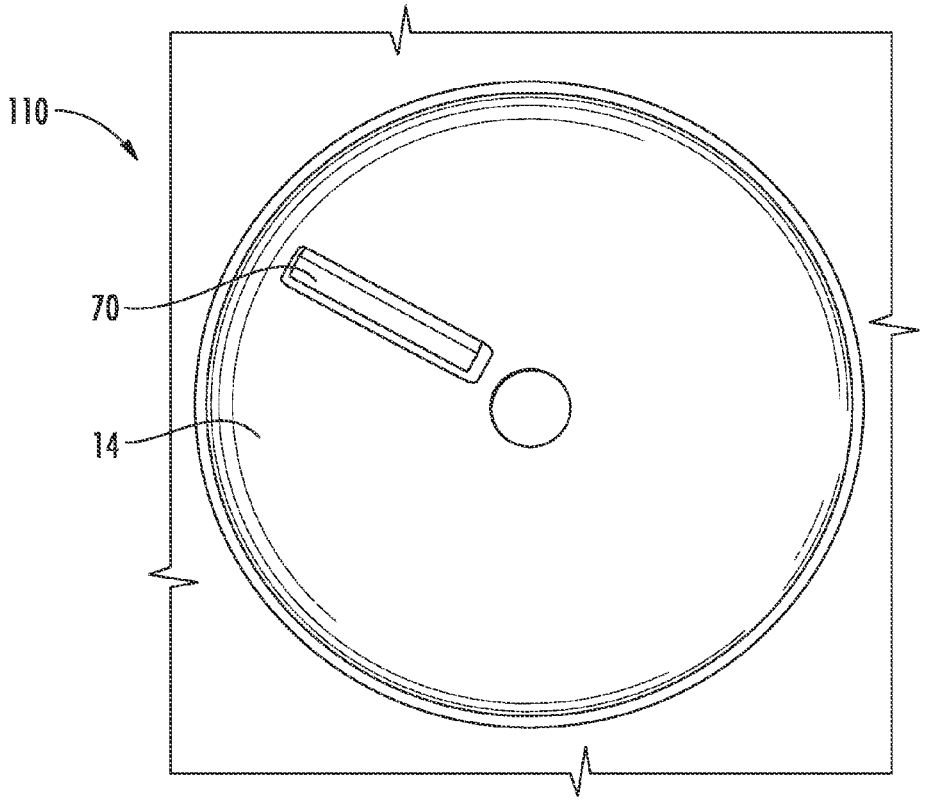
FIG. 13B is a top plan view of a crushed-cubed module.

The capability to provide at least three forms of ice is illustrated in FIGS. 4-9. Two forms of ice may be provided in a single ice manipulation module 10 when driven by a single motor 90. Therefore, all three forms of ice, namely crushed, shaved, and cubed, may be provided in the three possible combinations with three uniquely configured ice manipulation modules 10, as shown in FIGS. 13A-14B. Specifically, the present invention provides a crushed-cubed module 110 (FIG. 13B), a shaved-cubed module 112 (FIG. 13A), and a crushed-shaved module 114 (FIGS. 14A and 14B), collectively and generically referred to as the ice manipulation module 10. Each ice manipulation module 10 includes at least one ice modification member 70, 72, depending on which ice manipulation module 10 combination is present. Specifically, the ice manipulation module 10 includes a first ice modification member or a crushing blade 70 and/or a second ice modification member or a shaving blade 72. The crushing blade 70 and the shaving blade 72 are located proximate the base 14 of the ice manipulation module 10. The blades 70, 72 may be formed as one piece or may be completely separated. The illustrated examples show attachment of the blades 70, 72 to the base 14, but they may also be placed proximate, yet not attached, to the base 14, such that they are positioned to perform their crushing and shaving functions. The base 14 of the ice manipulation module 10 also includes an integrally formed trap door 80 or provides an operable connection to the trap door 80. The blades 70, 72 are positioned such that a leading edge 74 of each blade 70, 72 is configured to modify ice upon interaction with the ice pieces. Disposed within the ice manipulation module 10 is an impeller 76 that assists in facilitating the interaction of the ice pieces with the blades 70, 72. Specifically, the impeller 76 pushes the ice over the crushing or shaving blade 70, 72. The impeller 76 may have a variety of geometric configurations, including, but not limited to, a shovel type shape 77, a single helical shape 78, or a multiple helical shape 79 (FIGS. 10-12). The shovel type shape 77 is similar to a shovel blade. The shovel type shape 77 may include slight arcuate angles, but a substantially level blade may be employed. The substantially symmetrical shape allows for efficient ice manipulation in two directions. The helical embodiments function differently when the impeller 76 is rotated in opposite directions. This may be advantageous, depending upon the ice manipulation module 10 geometry or function desired. The impeller 76 is driven by a motor 90 located within the appliance 20. The impeller 76 and the motor 90 may be connected directly or via an output shaft 92 that extends between the motor 90 and the impeller 76. This connection provides the impeller 76 the ability to rotate in two directions.

In the crushed-shaved module 114, the motor 90 rotates the impeller 76 in a first direction A and the geometry of the impeller 76 pushes the ice pieces in the first direction A, while simultaneously applying a downward force. This motion initiates the interaction of the ice pieces with the leading edge 74 of the crushing blade 70, thereby modifying the ice pieces to crushed ice, as previously defined. In a shaving mode, the motor 90 turns the impeller 76 in a second direction B and the geometry of the impeller 76 pushes the ice pieces in the second direction B, while simultaneously applying a downward force (FIGS. 13 and 14). This motion initiates interaction of the ice pieces with the leading edge 74 of the shaving blade 72, thereby modifying the ice pieces to shaved ice, as previously defined. As an alternative to rotating the impeller 76, the base 14 of the ice manipulation module 10 may be operably connected to the motor 90, such that the motor 90 is capable of rotating the base 14, thereby also rotating the blades 70, 72. This motion would also initiate the above-discussed interaction of the ice pieces with the leading edge 74 of the blades 70, 72, based on the downward force of the impeller 76.

Figure 14A:
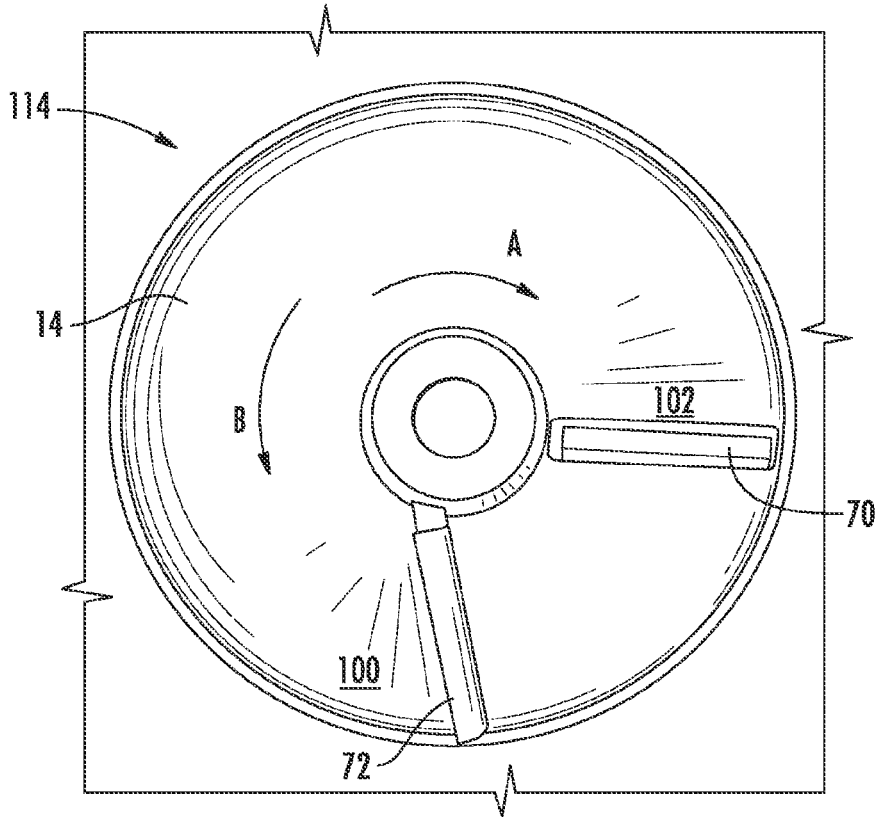
FIG. 14A is a top plan view of a crushed-shaved module.
Figure 14B:
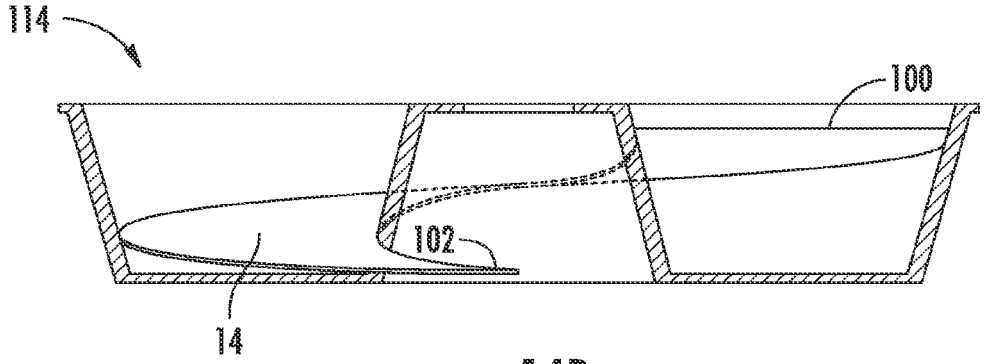
FIG. 14B is a side cross-sectional view of the crushed-shaved module.
Figure 17A:
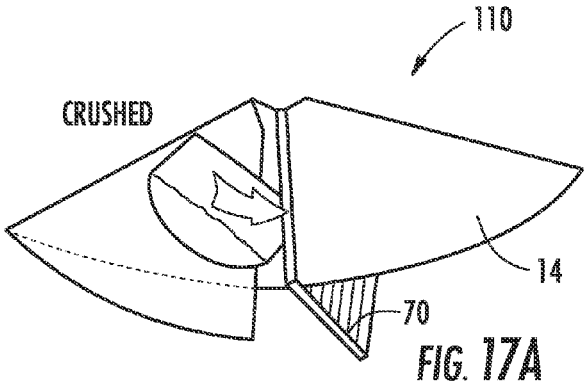
FIG. 17A is a top perspective view of the base having a crushing blade.
Figure 17B:
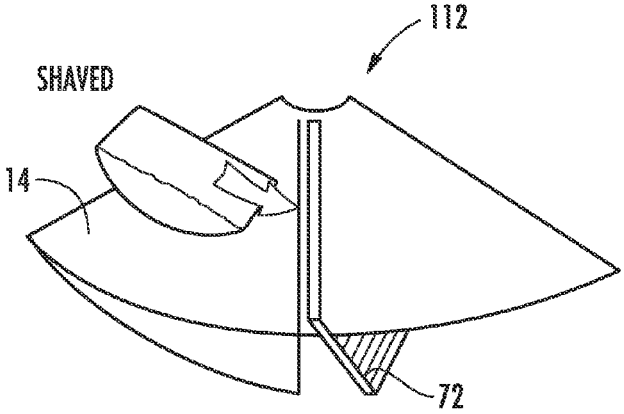
FIG. 17B is a top perspective view of the base having a shaving blade.
Figure 17C:
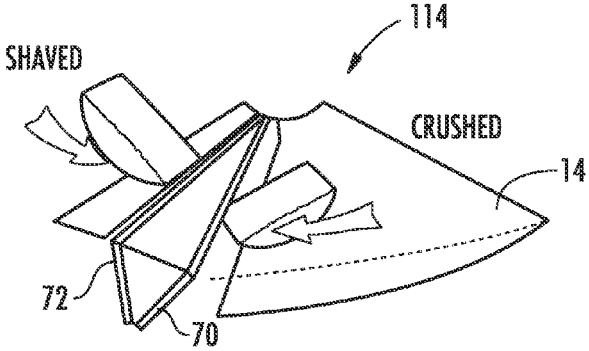
FIG. 17C is a top perspective view of the base having a crushing and shaving blade.

While it is conceived that similar sized blades 70, 72 may be employed to crush and shave if positioned at different angles, it is envisioned that the crushing blade 70 has a larger surface area than that of the shaving blade 72, based on the need to protrude deeper into ice pieces to effectively perform the crushing function. Conversely, the shaving blade 72 may only protrude slightly into the ice pieces, whereas too deep of a protrusion would result in an ice form not meeting the shaved ice parameter limitations as previously defined. Based on the need for a larger crushing blade 70, the base 14 of the ice manipulation module 10 descends from a base first level 100 to a base second level 102, as opposed to having a horizontally level base. Placing the crushing and shaving blades 70, 72 on a uniform horizontal base would result in a top edge of the crushing blade 70 to be positioned at a height greater than the shaving blade 72. Such a configuration may prevent the impeller 76 from most efficiently performing the pushing function, as the crushing blade 70 may interfere with the motion of the impeller 76. Therefore, a non-level base 14 allows for the accommodation of a larger crushing blade 70 to be placed at a position of the base 14 with a deeper or lower level than that of the shaving blade 72 position level. Such a base 14 configuration is illustrated in FIGS. 14A and 14B. The base 14 may descend gradually in a helical or spiral manner. In this arrangement, the shaving blade 72 is positioned proximate the first level 100, with the leading blade edge 74 facing in the direction of the base 14 descending direction. The base 14 descends gradually until reaching a lower most second level 102. The crushing blade 70 is positioned proximate the second level 102, with the crushing blade 70 top edge positioned proximate the same height and/or plane of that of the shaving blade 72 top edge. Subsequent to shaving or crushing, the ice may be dispensed under the blade 70, 72, into the dispensing zone 60, as shown in FIGS. 17A-17C. As an alternative to a gradual descent, the ice manipulation module 10 base 14 may accommodate the crushing blade 70 by having at least one step down from the base first level 100 to the base second level 102.

Both the crushed-cubed module 110 and the shaved-cubed module 112 typically only include one ice modification member 70 or 72, specifically the crushing blade 70 or the shaving blade 72. The manner in which ice pieces are crushed and shaved has been previously described in the crushed-shaved module 114 discussion. The crushed-cubed module 110 and the shaved-cubed module 112 typically have a substantially horizontal base 14, based on the lack of a need for accommodation of the differently sized blades 70, 72. In order to provide a user with a cubed form of ice, the base 14 includes a trap door 80 that allows unmodified ice pieces (typically in the form of cubes) to fall through the trap door 80 to the dispensing zone 60. Based on the presence of only one ice modification member 70 or 72, where the member 70 or 72 has only one leading edge 74, the ice simply glides over the dull non-leading edge when rotated in the direction opposite the leading edge 74, thereby leaving the ice pieces in their unmodified form.

Figure 15:
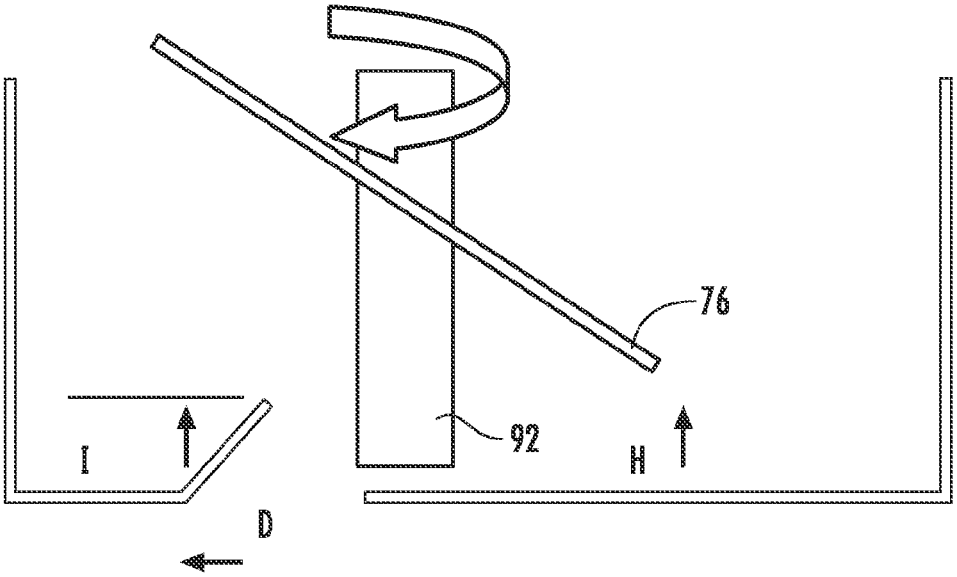
FIG. 15 is a front elevational view of the ice manipulation module illustrating ice modification parameters.

The positioning and geometry of the blades 70, 72 are critical factors in the shaving and crushing system. The physics behind such a system is illustrated in FIG. 15. The blade height (I) determines the thickness of the crushed piece, such that the greater the blade height, the thicker the crushed piece. Testing has determined that shaved ice is effectively produced with a blade height (I) of approximately two millimeters (2 mm), while crushed ice is effectively produced with a blade height (I) of approximately seven to nine millimeters (7-9 mm). The drop gap (D) regulates the piece size. Such regulation is accomplished based on the fact that no piece larger than the drop gap (D) may be dispensed to the user. Shaved ice will typically have a drop gap (D) of approximately six millimeters (6 mm), when used in conjunction with the aforementioned two millimeter (2 mm) blade, while crushed ice may require a drop gap (D) of approximately fourteen to eighteen millimeters (14-18 mm). An impeller gap (H) defines the minimum ice height available to push the ice around the ice manipulation module 10.

Figure 16:
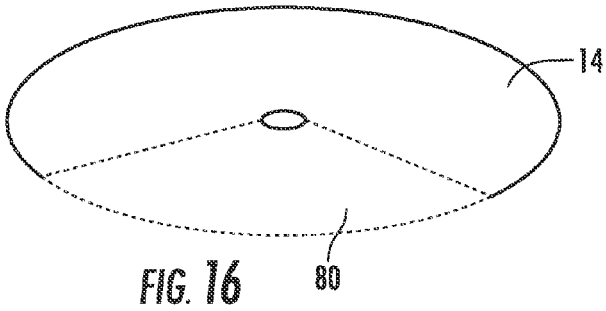
FIG. 16 is a top perspective view of a base having a trap door.

As discussed previously, the base 14 also includes the trap door 80 that allows for the dispensing of ice. Typically, the trap door 80 will lead to the dispensing zone 60, such as a chute 68. As illustrated in FIG. 16, the trap door 80 may be hingedly attached about a substantially vertical or a substantially horizontal axis. During the crushing or shaving mode, the trap door 80 remains in a closed position, whereas the trap door 80 is opened during dispensing of ice in a cubed form. A solenoid or some other mechanical or electromechanical device may be used to open the trap door 80, as controlled by the user interface 62 and/or the control mechanism.

Figure 18:
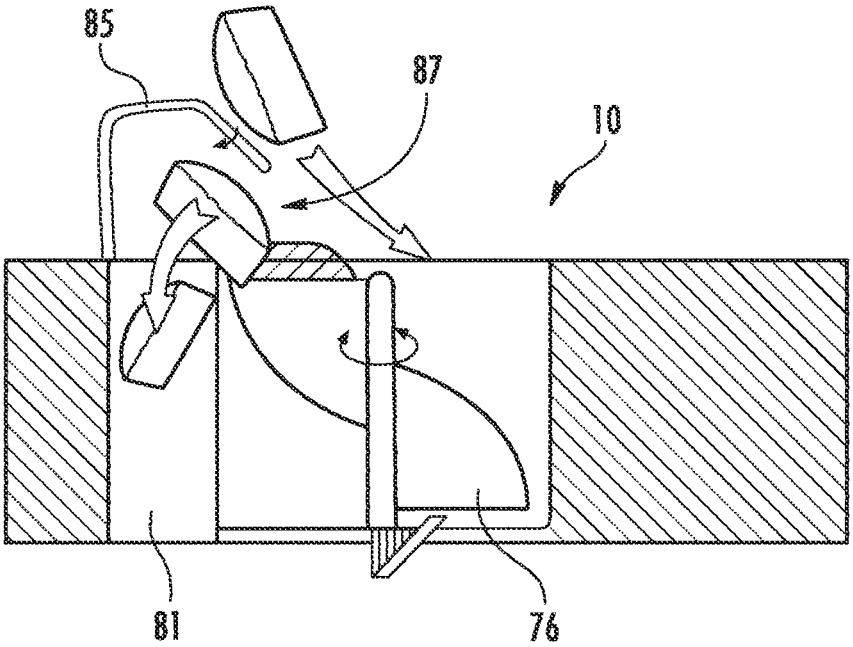
FIG. 18 is a front elevational view of the ice manipulation module illustrating an ice channel for dispensing ice.

Referring to FIG. 18, as an alternative or in addition to a hingedly attached trap door 80, cubed ice may be dispensed via an ice channel 81. The ice channel 81 is located adjacent to the ice manipulation module 10 and is formed by an upper covering 85. The upper covering 85 may be downwardly angled to allow ice pieces to fall into the ice manipulation module 10 from the ice maker 50. An opening 87 between the upper covering 85 and the ice manipulation module 10 is large enough to allow cubed ice to pass through and enter the ice channel 81. Cubed ice may be dispensed through the ice channel 81 when the impeller 76 is rotated in a specific direction. Specifically, in the crushed-cubed module 110 and the shaved-cubed module 112, when the impeller 76 is rotated in the direction opposite that of the crushing direction or the shaving direction, the impeller 76 forces cubed ice upwardly into the opening 87 and down through the ice channel 81.

In another embodiment, the ice manipulation module 10 removably engages a reservoir 12 that is mounted to the appliance 20, typically at the interior surface 34 of the freezer door 28. The reservoir 12 is positioned below the ice maker 50 and is capable of storing ice pieces. The ice manipulation module 10 may engage the reservoir 12 to provide functional capability of ice manipulation into three forms, namely crushed, shaved, and cubed.

A further aspect of the present invention is to provide a method of making an appliance 20. The method includes the step of forming a module-receiving area adapted to engageably receive at least one of a plurality of ice manipulation modules 10 selected from the group consisting of a crushed-cubed module 110, a shaved-cubed module 112, and a crushed-shaved module 114, wherein each one of the plurality of ice manipulation modules 10 includes at least one ice modification member. Provided is a motor 90 having an output shaft 92, adapted for rotation in a first direction and adapted for rotation in a second direction. An impeller 76 is connected to the output shaft 92 and is extended proximate the module-receiving area, wherein rotation of the output shaft 92 in the first direction causes a first ice manipulating condition and wherein rotation of the output shaft 92 in the second direction causes a second ice manipulating condition.

Advantageously, the present invention provides the ability to dispense three forms of ice to a user from a single space within an appliance. This ability improves on issues of spatial restraints within appliances.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An appliance comprising:

a module-receiving cavity disposed in the appliance;

an ice manipulation module disposed in the module-receiving cavity and configured to be alternatively connected with and removed from the module receiving cavity;

at least one ice modification member disposed inside and attached to the ice manipulation module, wherein each at least one ice modification member is stationary with respect to a base of the ice manipulation module;

a motor operably connected with the ice manipulation module and including an output shaft extending into the ice manipulation module;

an impeller connected with the output shaft proximate to the at least one ice modification member, the impeller being operable between a first directional rotation defining a first functional condition being at least one of ice dispensing, ice crushing and ice shaving, and a second directional rotation defining a second functional condition being at least one other of ice dispensing, ice crushing and ice shaving, wherein the impeller includes a single outwardly extending member, and wherein the single outwardly extending member is operated to perform the first and second functional conditions; and an ice chute proximate the ice modification member for dispensing ice, wherein when the first and second functional conditions are ice crushing and ice shaving, the single outwardly extending member is operable to further perform ice dispensing through the ice chute.

2. The appliance of claim 1, wherein the impeller extends outwardly from the output shaft and the single outwardly extending member of the impeller includes a rear end and a first side having a first angle and a second side having a second angle, wherein the first angle opposes the second angle, and wherein the first and second sides descend toward a central axis of the single outwardly extending member and intersect at a front location of the single outwardly extending member along the central axis, wherein the single outwardly extending member includes a blade curvature between the front location and the rear end defining a partially enclosed scoop, wherein the single outwardly extending member is configured to direct material downward in the first and second directional rotation.

3. The appliance of claim 1, wherein the single outwardly extending member of the impeller extends outwardly from the output shaft and includes a helical curvature, wherein an ice channel is located adjacent the ice manipulation module and includes an ice channel opening disposed superior to the ice manipulation module, and wherein the rotation of the impeller in one of the first directional rotation and the second directional rotation forces ice upward into the ice channel opening and into the ice channel for dispensing ice, and wherein the rotation of the impeller in the other of the first directional rotation and the second directional rotation forces ice downward and against the at least one ice modification member.

4. The appliance of claim 1, wherein the single outwardly extending member of the impeller extends outwardly from the output shaft and includes an opposing double helix geometry.

5. The appliance of claim 1, wherein the at least one ice modification member includes a first blade and a second blade, wherein the first and second blades are stationary with respect to a base of the ice manipulation module.

6. The appliance of claim 5, wherein the first blade is an ice shaving blade and wherein the second blade is an ice crushing blade.

7. The appliance of claim 1, further comprising a reservoir mounted to the module-receiving cavity, wherein the ice manipulation module is disposed at least partially within the reservoir upon attachment to the appliance.

8. The appliance of claim 1, further comprising:

a plurality of ice manipulation modules configured to be received by the module-receiving cavity, wherein the module-receiving cavity is configured to receive any one of the plurality of ice manipulation modules, wherein each of the plurality of ice manipulation modules performs two ice manipulating functions selected from the group consisting of shaving and crushing, shaving and cubing, or crushing and cubing.

9. An ice manipulation module comprising:

a housing adapted for alternative connection with and removal from a module-receiving cavity;

a first ice modification member and a second ice modification member, wherein each of the first and second ice modification members are disposed inside and attached to a base of the housing, wherein each of the first and second ice modification members are in a fixed position with respect to the housing, and wherein the first ice modification member is an ice shaving blade and wherein the second ice manipulation member is an ice crushing blade;

a motor operably connected with the ice manipulation module and including an output shaft extending into the ice manipulation module; and an impeller connected with the output shaft proximate to the ice modification member, the impeller being operable between a first ice manipulating condition defined by a first directional rotation of the impeller, and a second ice manipulating condition defined by a second directional rotation of the impeller, wherein the first ice manipulating condition includes at least one of dispensing, crushing and shaving, and wherein the second ice manipulating condition includes at least one other of dispensing, crushing and shaving, and wherein the impeller includes an outwardly extending curved portion that rotates to perform the first and second ice manipulating conditions, and wherein when the first and second ice manipulating conditions are crushing and shaving, the outwardly extending curved portion is further operable to at least partially perform a dispensing function.

10. The ice manipulation module of claim 9, wherein the impeller extends outwardly from the output shaft and the outwardly extending curved portion includes a rear end and a first side having a first angle and a second side having a second angle, wherein the first angle opposes the second angle, and wherein the first and second sides descend toward a central axis of the outwardly extending curved portion and intersect at a front location of the outwardly extending curved portion along the central axis, wherein the outwardly extending curved portion includes a blade curvature between the front location and the rear end defining a partially enclosed scoop, wherein the outwardly extending curved portion directs material downward in the first and second ice manipulating conditions, and wherein the impeller is free of additional outwardly extending portions.

11. The ice manipulation module of claim 9, wherein the impeller extends outwardly from the output shaft and the outwardly extending curved portion includes a helical curvature, wherein an ice channel is located adjacent the ice manipulation module and includes an ice channel opening disposed superior to the ice manipulation module, and wherein the rotation of the impeller in one of the first ice manipulating condition and the second ice manipulating condition forces ice upward into the ice channel opening and into the ice channel for dispensing ice, and wherein the rotation of the impeller in the other of the first ice manipulating condition and the second ice manipulating condition forces ice downward and against the at least one ice modification member.

12. The ice manipulation module of claim 9, wherein the outwardly extending curved portion includes a double helix geometry.

13. The ice manipulation module of claim 9, wherein the first and second ice modification members include a first blade and a second blade, respectively, wherein the first and second blades are in a fixed position with respect to the housing.

14. The ice manipulation module of claim 13, wherein the first blade is an ice shaving blade and wherein the second blade is an ice crushing blade, and wherein the first blade is set at a first height relative to the base and the second blade is set at a second height relative to the base, the first height being different than the second height.

15. The ice manipulation module of claim 9, further comprising a reservoir mounted to the module-receiving cavity, wherein the removable module is disposed at least partially within the reservoir upon attachment to an appliance.

16. The ice manipulation module of claim 9, further comprising:

a plurality of ice manipulation modules configured to be received by the housing, wherein the housing is configured to receive any one of the plurality of ice manipulation modules, wherein each of the plurality of ice manipulation modules includes the at least one ice modification member and performs two ice manipulating functions selected from the group consisting of shaving and crushing, shaving and cubing, or crushing and cubing.

17. A method of making an appliance comprising:

forming a module-receiving area adapted to engagably receive at least one of a plurality of ice manipulation modules selected from the group consisting of a crushed-cubed module, a shaved-cubed module, and a crushed-shaved module, wherein each one of the plurality of ice manipulation modules includes a base and at least one ice modification member attached to the base of the respective ice manipulation module, wherein each at least one ice modification member is stationary with respect to the respective ice manipulation module;

providing a motor having an output shaft, adapted for rotation in a first direction and adapted for rotation in a second direction;

connecting an impeller to the output shaft, the impeller having a single outwardly extending curved portion; and extending the impeller proximate the module-receiving area, wherein rotation of the output shaft in the first direction causes the single outwardly extending curved portion to perform a first ice manipulating condition and wherein rotation of the output shaft in the second direction causes the single outwardly extending curved portion to perform a second ice manipulating condition, wherein the first ice manipulating condition includes at least one of dispensing, crushing and shaving, and wherein the second ice manipulating condition includes at least one other of dispensing, crushing and shaving, and wherein when the first and second ice manipulating conditions are crushing and shaving, rotation of the single outwardly curved portion in at least one of the first and second directions further performs a dispensing function.

18. The method of claim 17, further comprising the step of providing a trap door located proximate the at least one ice manipulation module.

19. The method of claim 17, further comprising the step of connecting a user interface to the motor to control the operation of the motor.

20. The method of claim 17, further comprising the step of rotating the output shaft including the impeller having a helical surface to cause one of the first and second ice manipulating conditions, wherein the impeller forces ice upward into an ice channel opening disposed superior to the ice manipulation module and into an ice channel for dispensing ice.

* * * * *